US011421537B2

(12) United States Patent
Fanelli et al.

(10) Patent No.: US 11,421,537 B2
(45) Date of Patent: Aug. 23, 2022

(54) TURBINE ENGINE BLADE EQUIPPED WITH A COOLING CIRCUIT WITH OPTIMIZED CONNECTION ZONE

(71) Applicants: SAFRAN AIRCRAFT ENGINES, Paris (FR); SAFRAN, Paris (FR)

(72) Inventors: Jeremy Jacques Attilio Fanelli, Moissy-Cramayel (FR); Romain Pierre Cariou, Moissy-Cramayel (FR); Thomas Olivier Michel Pierre De Rocquigny, Moissy-Cramayel (FR); Ba-Phuc Tang, Moissy-Cramayel (FR)

(73) Assignees: SAFRAN AIRCRAFT ENGINES, Paris (FR); SAFRAN, Paris (FR)

( * ) Notice: Subject to any disclaimer, the term of this patent is extended or adjusted under 35 U.S.C. 154(b) by 153 days.

(21) Appl. No.: 16/824,526

(22) Filed: Mar. 19, 2020

(65) Prior Publication Data

US 2020/0300095 A1 Sep. 24, 2020

(30) Foreign Application Priority Data

Mar. 22, 2019 (FR) ..... 1903023

(51) Int. Cl.
*F01D 5/18* (2006.01)

(52) U.S. Cl.
CPC ..... *F01D 5/18* (2013.01); *F05D 2220/30* (2013.01); *F05D 2260/20* (2013.01)

(58) Field of Classification Search
CPC ..... F05D 2260/20; F05D 2220/30; F05D 2240/126; F01D 5/18; F01D 9/02
See application file for complete search history.

(56) References Cited

U.S. PATENT DOCUMENTS 5,813,836 A * 9/1998 Starkweather ..... F01D 5/187 415/173.4
8,016,547 B2 * 9/2011 Propheter-Hinckley ..... F01D 5/188 415/115

(Continued)

FOREIGN PATENT DOCUMENTS

EP 3214269 A1 9/2017
WO 2014/116475 A1 7/2014

OTHER PUBLICATIONS

Preliminary Research Report received for French Application No. 1903023, dated Nov. 19, 2019, 5 pages (1 page of French Translation Cover Sheet and 4 pages of original document).

*Primary Examiner* — Courtney D Heinle
*Assistant Examiner* — Andrew Thanh Bui
(74) *Attorney, Agent, or Firm* — Womble Bond Dickinson (US) LLP

(57) ABSTRACT

A turbine engine vane including a blade extending following a radial axis and a cooling circuit arranged inside the blade, the cooling circuit including a first cavity and a second cavity arranged downstream from the first cavity following a direction of circulation of a cooling fluid, the first and second cavities extend radially inside the blade and being separated at least partially by a radial partition having a radially external free end which delimits at least partially a passage connecting the first and second cavities, the radial partition connecting a first wall in contact with the outside environment of the blade to a second opposite wall substantially following a transversal axis, perpendicular to the radial axis, respectively in a connection zone. According to the invention, at least one connection zone presents a thickening having a substantially triangular general transversal cross-section.

12 Claims, 2 Drawing Sheets

(56) References Cited

U.S. PATENT DOCUMENTS

| | | | | |
|---|---|---|---|---|
| 2015/0110639 | A1 | 4/2015 | Herzlinger et al. | |
| 2021/0148233 | A1* | 5/2021 | Dube | F01D 5/147 |

* cited by examiner

TURBINE ENGINE BLADE EQUIPPED WITH A COOLING CIRCUIT WITH OPTIMIZED CONNECTION ZONE

FIELD OF THE INVENTION

The present invention concerns the field of turbine engines and, in particular, a turbine engine blade equipped with a cooling circuit intended to cool it.

TECHNICAL BACKGROUND

The technical background comprises patent documents WO-A1-2014/116475, EP-A1-3 214 269 and US-A1-2015/110639.

Turbine engine vanes, in particular high-pressure turbine blades are subjected to very high temperatures which can reduce their lifespan and degrade the performance of the turbine engine. Indeed, the turbine engine turbines are arranged downstream from the combustion chamber of the turbine engine which ejects a hot gaseous flow, which is expanded by the turbines and makes it possible to drive them in rotation to operate the turbine engine. The high-pressure turbine which is placed directly at the outlet of the combustion chamber is subjected to the highest temperatures.

In order to make it possible for the turbine blades to support these severe thermal constraints, it is known to provide a cooling circuit wherein a relatively colder air circulates which is taken from the compressors, the latter being located upstream from the combustion chamber. More specifically, each turbine vane comprises a blade with a pressure side and an suction side which are connected upstream by a leading edge and by a trailing edge.

The cooling circuit comprises several cavities inside the blade between the pressure and suction sides of the blade, some of which communicate together and which are supplied by the cooling air from the base of the blade, some of this cooling air opening into outlet orifices which are placed in the vicinity of the trailing edge. These orifices deliver cooling air jets on the walls of the blade.

It is known that the cooling circuit comprises a partition extending, on the one hand, radially, and on the other hand, transversally in the blade so as to form a first "rising" cavity and a second "descending" cavity arranged successively along the direction of circulation of the cooling air and which communicate together through a curved passage. These cavities and the passage are known by the expression of "trombone" circuit. The curved passage is delimited by the radially external free end of the partition which presents a curvature or turning of the partition. This makes it possible to scan a large surface inside the blade for its cooling.

The partition transversally connects a first wall, exposed to the outside environment of the blade and in particular, to the hot gaseous flows, to a second wall which are opposite. The radially external free end of the partition forms a right angle (90°) with each first and second wall at the level of the intersection of the partition forming a connection zone. The intersection made between the first wall and the partition is highly mechanically constrained. This is due to the presence of high thermal gradients between the outside of the blade and inside of it thus inducing a difference in thermal dilatations between the inside and the outside of the blade and in particular at the level of the connection zone. The lifespan of the vane is impacted and the vibratory capacity of it reduced.

SUMMARY OF THE INVENTION

The aim of the present invention is to reduce the mechanical constraints that the blade of the vane is subjected to due to the arrangement of a cooling circuit while avoiding the significant structural modifications of the vane.

This aim according to the invention is achieved thanks to a turbine engine vane comprising a blade extending following a radial axis and a cooling circuit arranged inside the blade, the cooling circuit comprising a first cavity and a second cavity arranged downstream from the first cavity following a direction of circulation of a cooling fluid, the first and second cavities extending radially inside the blade and being separated at least partially by a radial partition having a radially external free end which delimits at least partially a passage connecting the first and second cavities, the radial partition connecting a first wall in contact with the outside environment of the blade to a second wall opposite, substantially following a transversal axis, perpendicular to the radial axis, respectively in a connection zone, at least one connection zone presenting a thickening having a substantially triangular general transversal cross-section.

Thus, this solution makes it possible to achieve the abovementioned aim. In particular, the thickening of the connection zone at the level of one of the walls of the blade being subjected to high thermal and mechanical constraints where the radial partition is connected, makes it possible to reduce the maximum constraint in this place. This configuration makes it possible to reduce constraints by around 15% which is significant and makes it possible to improve, on the one hand, the lifespan of the vane and on the other hand, the vibratory capacities of them. Moreover, such a configuration makes it possible to offset the maximum thermal constraint zone of one of the walls inwards of the blade, which is colder, which further improves the lifespan of the vane. Finally, this solution is simple and economical to implement.

The vane also comprises one or more of the following features, taken individually or in combination:

- the thickening presents an external peripheral surface with a peak edge inclined following a predetermined angle with respect to a line of the radially external end which is perpendicular to the first wall.
- the thickening presents a predetermined width L measured between an internal surface of the first wall and an edge from which the thickening of the radially external free end is increased, the predetermined width being equal to or less than half of the width of the partition following the transversal axis.
- the thickening comprises a first curved surface portion with a first radius R1 which connects the external peripheral surface to an external surface of the radially external free end.
- the thickening comprises a second curved surface portion with a second radius R2 which connects the external peripheral surface to an internal surface of the first wall.
- the first radius is greater than the second radius.
- the passage comprises a passage cross-section which depends on the predetermined angle, of the first radius, of the second radius, and on the predetermined width.
- the thickening protrudes inwards from the blade form an internal surface of the first wall.
- the first wall is defined by the suction side.
- the second wall is defined by an internal wall extending transversally between the suction side and the pressure side.
- the suction side and the pressure side are connected upstream by a leading edge and downstream by a trailing edge.
- the blade extends between a free end and a connection end at the base of the vane, the free end comprising a closing wall delimiting the passage.

The invention also concerns a turbine engine turbine comprising at least one turbine engine vane presenting any one of the abovementioned features.

The invention further concerns a turbine engine comprising at least one turbine engine turbine such as mentioned above.

BRIEF DESCRIPTION OF THE FIGURES

The invention will be better understood, and other aims, details, features and advantages of it will appear more clearly upon reading the following detailed, explanatory description of embodiments of the invention given as purely illustrative and non-limiting examples, in reference to the appended schematic drawings, wherein.

DETAILED DESCRIPTION OF THE INVENTION

Figure 1:
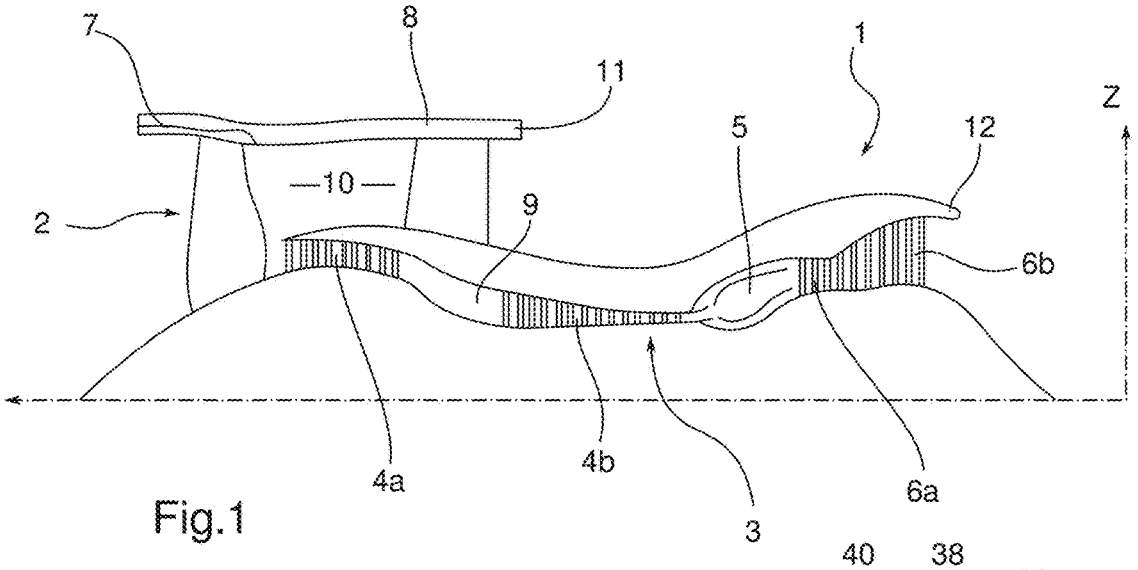
FIG. 1 is an axial, cross-sectional and partial view of a turbine engine example to which the invention applies.

FIG. 1 shows an axial, cross-sectional view of a turbine engine 1 of longitudinal axis X to which the invention applies. The turbine engine represented is a bypass and double-body turbine engine intended to be mounted on an aircraft according to the invention. Of course, the invention is not limited to this type of turbine engine.

This bypass turbine engine 1 generally comprises a fan 2 mounted upstream from a gas generator 3. In the present invention, and generally, the terms "upstream" and "downstream" are defined with respect to the circulation of gases in the turbine engine and here following the longitudinal axis X (and even left to right in FIG. 1). The terms "axial" and "axially" are defined with respect to the longitudinal axis X. Likewise, the terms "radial" and "internal" and "external" are defined with respect to a radial axis Z perpendicular to the longitudinal axis X and facing the extension with respect to the longitudinal axis X.

The gas generator 3 comprises, upstream to downstream, a low-pressure compressor 4*a*, a high-pressure compressor 4*b*, a combustion chamber 5, a high-pressure turbine 6*a* and a low-pressure turbine 6*b*.

The fan 2, which is surrounded by a fan case 7 carried by a nacelle 8, divides the air which enters into the turbine engine in a primary air flow which passes through the gas generator 3 and in particular, in a primary duct 9, and in a secondary air flow which circulates around the gas generator in a secondary duct 10.

The secondary air flow is ejected by a secondary nozzle 11 at the end of the nacelle as well as the primary air flow being ejected outside of the turbine engine via an ejection nozzle 12 located downstream from the gas generator 3.

The high-pressure turbine 6*a*, like the low-pressure turbine 6*b*, comprises one or more stages. Each stage comprises a stator blading mounted upstream from a mobile blading. The stator blading comprises a plurality of stator or fixed vanes, called turbine stator vane, which are distributed circumferentially about the longitudinal axis X. The mobile blading comprises a plurality of mobile vanes which are also distributed circumferentially around a disc centred on the longitudinal axis X. The distributors deviate and accelerate the aerodynamic flow at the outlet of the combustion chamber to the mobile vanes such that these are rotated.

Figure 2:
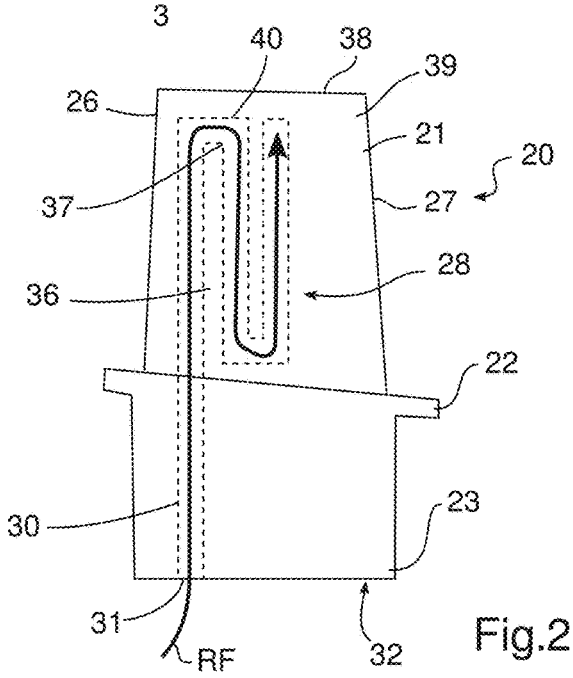
FIG. 2 schematically represents an axial cross-section of a turbine engine vane with a cooling circuit according to the invention.
Figure 3:
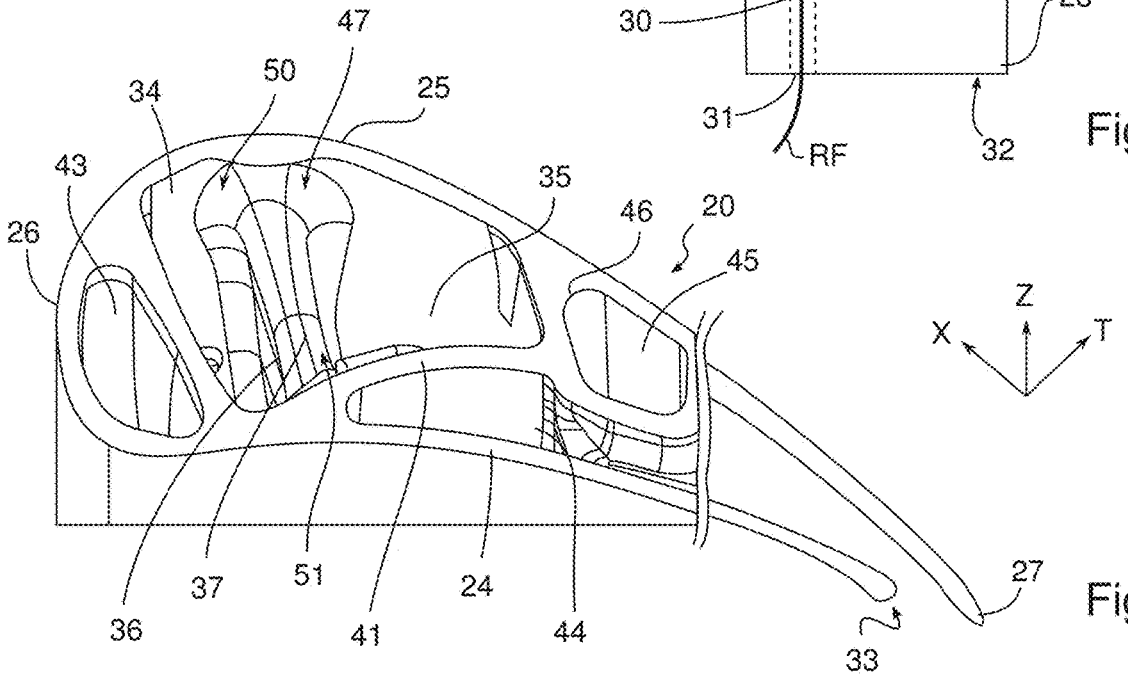
FIG. 3 is a perspective and radial cross-sectional view of an upper portion of a blade of a turbine engine vane comprising a cooling circuit according to the invention.

In reference to FIGS. 2 and 3, each turbine vane (and here a high-pressure turbine mobile vane 20) comprises a blade 21 raising radially from a platform 22. The latter is carried by a base 23 which is intended to be installed in one of the corresponding grooves of the turbine disc. Each blade 21 comprises a pressure side 24 and a suction side 25 which are connected upstream by a leading edge 26 and downstream by a trailing edge 27. The pressure and suction sides are opposite one another, following a transversal axis T which is perpendicular to the longitudinal and radial axes.

The vane 20 comprises a cooling circuit 28 which is arranged inside the blade and which is intended to cool the walls of the blade being subjected to high temperatures of the primary air flow leaving the combustion chamber 5 and passing through it. The cooling circuit 28 comprises several cavities which communicate between them so as to form a trombone type conduit. The latter comprises several curved or turning passages (by around 180°) such that the cooling fluid (here, the cooling air), sweeps all of the vane and from top to bottom following the radial axis. The cooling of the blade is thus optimised.

The base 23 comprises a supply channel 30 which comprises a cooling air inlet 31 taken from downstream from the combustion chamber such that on the low-pressure compressor and which opens into the trombone type conduit. The channel 30 also opens onto a radially internal face 32 of the base of the blade which comprises the cooling air inlet. The cooling circuit also comprises outlet orifices 33 which are arranged in the vicinity of the trailing edge 27 of the blade. The outlet orifices 33 are oriented substantially following the longitudinal axis X and are aligned and distributed regularly substantially following the radial axis. In this manner, the cooling air RF which circulates from the base of the blade passes through the cavities inside the blade and opens into the outlet orifices 33.

Figure 4:
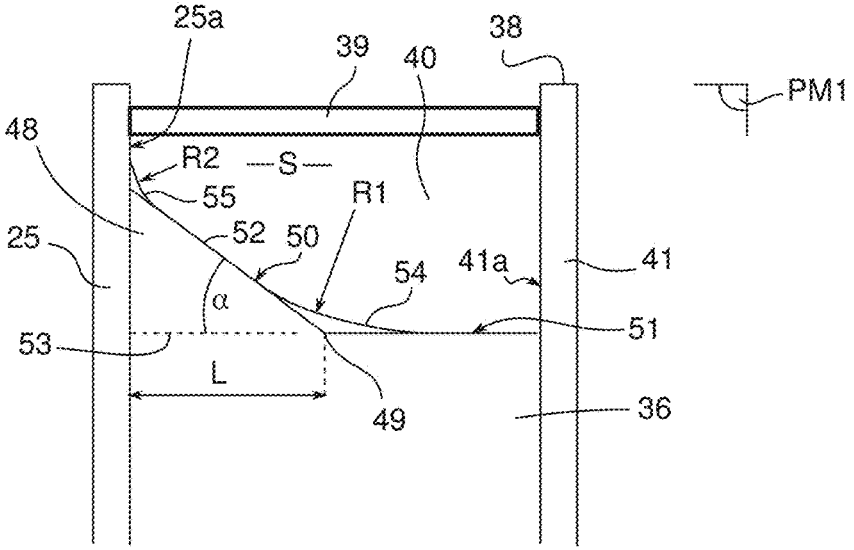
FIG. 4 is a schematic view of an arrangement example of a connection zone with thickening between a partition and one of the walls of a blade delimiting at least one cavity of the cooling circuit according to the invention.

As is illustrated in detail in FIG. 3, the cooling circuit 28 comprises several cavities arranged successively upstream to downstream from the blade. In particular, a first cavity 34 and a second cavity 35 each extend following the radial axis in the blade. The second cavity 35 is arranged downstream from the first cavity 34 following the direction of circulation of the cooling air (and upstream to downstream following the longitudinal axis X). The first cavity 34 and the second cavity 35 are separated, at least partially, by a first radial partition 36 which has a radially external free end 37, here semi-cylindrical. The latter is located at the level of the free end 38 of the blade (radially opposite the end for connecting to the base of the vane). The free end 38 of the blade moreover comprises a closing wall 39 as is schematically represented in FIG. 4 which makes it possible to contain the cooling air inside the blade for its cooling. The radial length of the partition is less than the radial height between the closing wall and the internal end for connecting the blade to the base.

The first cavity 34 and the second cavity 35 are connected (and/or communicate together) by a first passage 40 of cooling fluid which is located in the upper portion of the radial partition 36, following the radial axis, and which is delimited at least partially by the radially internal free end 37. The closing wall 39 also delimits the first passage 40. The passage is curved. The radially external free end comprises a fillet presenting an external surface 51 and which connects two opposite edges of the radial partition 36 following the chord of the blade.

The radial partition 36 connects a first wall to a second wall opposite the blade substantially following the transversal axis respectively in connection zones 47. In the example represented, the first wall is in contact with the outside environment of the blade being subjected to hot gaseous flows and is formed by the suction side 25. The second wall is itself formed by an internal wall 41 which extends on the one hand, following the radial axis and on the other hand, following a direction substantially parallel to the chord of the vane (or substantially along the longitudinal axis X).

Alternatively, the first wall is formed by the pressure side since it is also subjected to the hot gaseous flows. In this case, the radial partition extends transversally between the pressure side 24 and the internal wall 41 to which it is connected with connection zones respectively. Also, according to another alternative, the partition 36 is connected to the pressure side and to the suction side between which this extends transversally.

Upstream from the first cavity 34, an upstream cavity 43 which extends radially along the vicinity of the leading edge is arranged. A third cavity 45 is located downstream from the second cavity 35. This third cavity is separated from the second cavity by a second partition 46 which extends transversally between the pressure side and a portion of the internal wall 41. The second partition 46 is connected to the closing wall 39 at its external end while its radially internal end is free to form a second cooling air passage. A lower cavity 44 extends following the radial axis and transversally between the internal wall 41 and the pressure side.

The cavities 34, 35, 45 close the trombone type conduit.

In reference to FIGS. 3 and 4, the connection zone 47 (located between the suction side and the partition) presents a thickening 48 having a substantially triangular general transversal cross-section. This cross-section has, in particular, the shape of a right-angled triangle. The two sides of the triangle adjacent to the right angle are formed by a pressure side wall portion and a partition portion. The thickening 48 raises from the radially external free end 37 of the partition from an edge 49, here semi-circular.

In very schematic FIG. 4 in particular, the thickening 48 presents an external peripheral surface 50 which is connected to the external surface 51 substantially from the radially external free end of the partition with a surface continuity. The external peripheral surface 50 presents an inclined peak edge 52 (hypotenuse of the right-angled triangle) following an alpha angle (a) predetermined with respect to a line 53 of the radially external free end 37 which is perpendicular to the suction side (and/or which defines a median plane PM1 (in the plane of FIG. 4) of the partition). This predetermined angle is advantageously, but in a non-limiting manner, of between 30° and 50°. Preferably, the predetermined angle is of between 36° and 45°. The predetermined angle is a compromise between the improvement of the mechanical strength (reduction of constraints) and a low obstruction of the passage cross-section of the passage 40 (described below) in order to limit the load losses in terms of the blade and a cross-section reduction of the casting core (described below) which could weaken it, in terms of the casting assembly. This preferable value range of the angle corresponds to optimum levels.

The thickening 48 presents a predetermined width L measured between the internal surface 25*a* of the suction side and the edge 49 from which the thickening raises from the radially external end (in particular, from the peak of the peak edge 52). The predetermined width is equal or less than half of the width of the partition following the transversal axis. In the present example, the width of the partition is around 2.40 mm.

The thickening 48 also comprises a first curved surface portion 54 with a first radius R1 which connects the external peripheral surface 50 to the external surface 51 of the radially external free end 37 of the partition. In this example, the first surface portion is concave. The second radius is around 3.6 mm. The thickening 48 also comprises a second curved surface portion 55 with a second radius R2 which connects the external peripheral surface 50 to the internal surface 25*a* of the suction side. The second radius R2 is greater than the first radius R1. Likewise, the second surface portion is concave. In the present case, the second radius is around 5 mm.

The passage 40 presents a transversal cross-section S which depends on the predetermined width L of the thickening following the transversal axis, on the alpha inclination angle, on the first radius, and on the second radius. This makes it possible to limit the obstruction of the cooling air flow passage from the first cavity to the second cavity. The predetermined cross-section is around 23.7 mm by considering the examples of dimensions described above.

Advantageously, but in a non-limiting manner, the vane is made of a metal alloy and following a production method using the cire perdue casting technique or lost wax moulding. The metal alloy is preferably nickel-based and can be monocrystalline.

This method comprises a first step of producing one or more casting cores. In the present example, the vane comprising a blade provided with several cavities is made from several casting cores forming a casting assembly. The latter comprises, in particular, a first core and a second core which are made of a refractory material such as a ceramic material. The first core presents the complementary shape of the cavities for circulating cooling fluid in the blade. In particular, the first core comprises a joining zone between a first and a second wing extended following a radial height, the joining zone having a complex shape intended to form, as a negative, the connection zone between the first wall of the blade and the partition.

The first and the second cores are assembled together by connecting elements to hold them in position against one another.

Following another step of the method, wax or an equivalent material is injected around cores which are arranged beforehand, advantageously, but in a non-limiting manner, in a press. Once the wax is cooled, a model is obtained comprising cores buried in the wax.

The model is arranged on a column with other similar models so as to form a cluster.

The method further comprises the production of a shell made of a refractory material around the cluster and which acts as a mould. The refractory material is, in the present example, a ceramic. The shell is made by immersing the cluster several times in a ceramic slip.

Following another step of the method, molten metal is poured or cast inside the shell so as to fill the cavities obtained during the removal of the wax in the models in particular, and intended to form the metal parts, here the turbine blades. Indeed, prior to this metal pouring step, a wax removal step is carried out.

When the shell is cooled and solidified, a shakeout step makes it possible to destroy the shell and the cores made of metal parts (vane) so as to make the final vane and the cavities for circulating cooling fluid appear.

Figure 5:
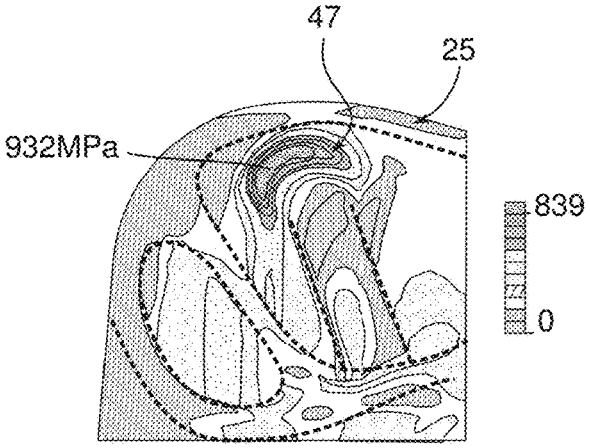
FIG. 5 illustrates a mapping of the constraints which can deform the wall of a blade at the level of a connection zone between a wall and a partition of the blade of the prior art.
Figure 6:
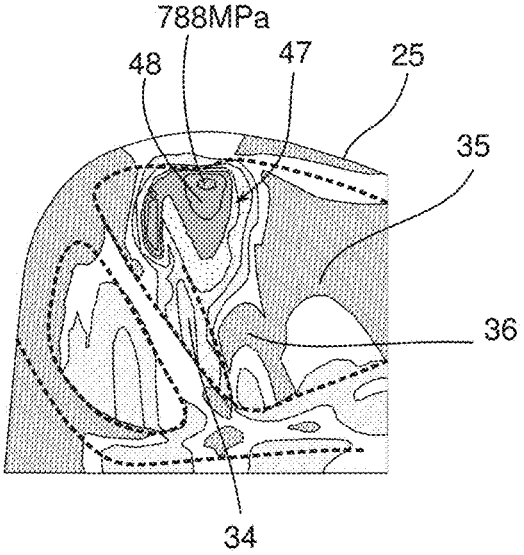
FIG. 6 illustrates a mapping of the constraints which can deform the wall of a blade at the level of a connection zone with thickening between a wall and a partition according to the invention.

In FIGS. 5 and 6 are represented from ISO scale mappings of the mechanical constraints which are likely to deform the suction side of the blade at the level of the connection zone 47 with the partition. In FIG. 6, as a perspective and a top view, the conventional connection zone of a blade of the prior art is seen, where a right angle is formed between the suction side and the partition and in FIG. 5, the connection zone with a thickening localised with a triangular-shaped transversal cross-section. With the localised thickening, the mechanical constraint is reduced by around 15%. Indeed, with the connection zone at a right angle, the maximum constraint is concentrated in the connection zone and presents a crescent shape on either side of the right angle. The maximum constraint is around 932 Mpa. However, with the thickening of the connection zone, the constraint is distributed over the whole connection zone and the maximum constraint presents a pea-shape and reaches 788 Mpa, which is a significant increase.

Figure 7:
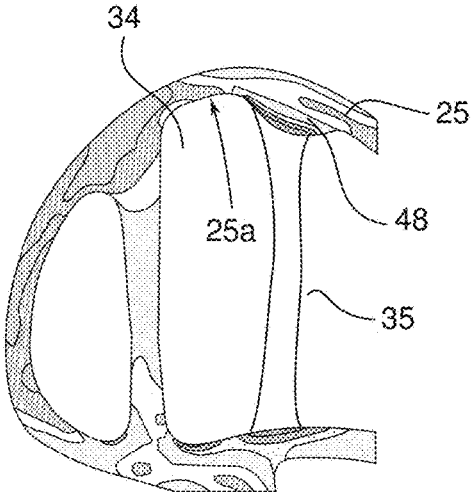
FIG. 7 illustrates a mapping of the constraints which can deform the pressure side and the critical zone of it which is offset inwards from the blade at the level of the connection zone.

FIG. 7 also illustrates a mapping of the constraints localised on the suction side and following a radial cross-section of the blade at the level of the connection zone. It is seen that the thickening 48 protrudes inwards from the blade from the internal surface 25*a*, following the transversal axis T. In particular, it is seen that the thickening presents an open U-shaped radial cross-section. Such a configuration makes it possible to offset the constraint zone inwards from the blade, which is colder than the suction side, where the thermal gradient is significant. Before this thickening, the maximum constraint zone is located in the suction side, while with this solution, the constraint zone is offset beyond the limit of the suction side (internal surface) and is located in the thickening and close to the partition itself inside the blade.

The invention claimed is:

1. A turbine engine vane comprising a blade extending following a radial axis and a cooling circuit arranged inside the blade, the cooling circuit comprising a first cavity and a second cavity arranged downstream from the first cavity following a direction of circulation of a cooling fluid, the first and second cavities extending radially inside the blade and being separated at least partially by a radial partition having a radially external free end which delimits at least partially a passage connecting the first and second cavities, the radial partition connecting a first wall which is in contact with the outside environment of the blade to a second wall respectively in a connection zone, the first and second walls are substantially opposite following a transversal axis which is perpendicular to the radial axis, characterised in that at least one connection zone presents a thickening having a substantially triangular general transversal cross-section.

2. The turbine engine vane according to claim 1, wherein the thickening presents an external peripheral surface with a peak edge inclined following a predetermined angle with respect to a line of the radially external free end which is perpendicular to the first wall.

3. The turbine engine vane according to claim 1, wherein the thickening presents a predetermined width L measured between an internal surface of the first wall and an edge from which the thickening raises from the radially external free end, the predetermined width being equal to or less than half of the width of the partition following the transversal axis.

4. The turbine engine vane according to claim 2, wherein the thickening comprises a first curved surface portion with a first radius R1 which connects the external peripheral surface to an external surface of the radially external free end.

5. The turbine engine vane according to claim 2, wherein the thickening comprises a second curved surface portion with a second radius R2 which connects the external peripheral surface to an internal surface of the first wall.

6. The turbine engine vane according to claim 2, wherein the passage presents a passage cross-section which depends on the predetermined angle, on a first radius of the thickening, on a second radius of the thickening and on a predetermined width of the thickening.

7. The turbine engine vane according to claim 1, wherein the thickening protrudes inwards from the blade from an internal surface of the first wall.

8. The turbine engine vane according to claim 1, wherein the first wall is defined by the suction side and the second wall is defined by an internal wall extending transversally between the suction side and a pressure side.

9. The turbine engine vane according to claim 1, wherein the blade extends between a free end and an end for connecting to the base of the vane, the free end comprising a closing wall delimiting the passage.

10. A turbine engine turbine comprising at least one vane according to claim 1.

11. A turbine engine comprising at least one turbine according to claim 10.

12. The turbine engine vane according to claim 1, wherein the thickening has a substantially triangular cross-section at least in a plane having the radial axis.

* * * * *